US005945357A

United States Patent [19]

Quigley

[11] Patent Number: 5,945,357

[45] Date of Patent: Aug. 31, 1999

[54] MULTI-LAYER PRESS FABRIC COMPRISING LOOPED, KNIT YARNS WOVEN IN AN UPPER LAYER OF FABRIC

[75] Inventor: Scott Quigley, Townville, S.C.

[73] Assignee: Wangner Systems Corporation, Greenville, S.C.

[21] Appl. No.: 08/946,158

[22] Filed: Oct. 7, 1997

[51] Int. Cl.[6] ..... D03D 15/00

[52] U.S. Cl. ..... 442/189; 442/208; 442/239; 442/240; 162/900; 139/383 A

[58] Field of Search ..... 442/189, 208, 442/239, 240, 206, 207; 139/383 A, 383 AA; 162/900

[56] References Cited

U.S. PATENT DOCUMENTS 3,030,690 4/1962 Mizell ..... 139/383 A
4,856,562 8/1989 Dufour ..... 139/383 A
4,883,097 11/1989 Dufour ..... 139/383 A
4,948,658 8/1990 Halker ..... 428/234

FOREIGN PATENT DOCUMENTS 0 106 132 4/1984 European Pat. Off. .

*Primary Examiner*—Marion McCamish
*Assistant Examiner*—Cheryl Juska
*Attorney, Agent, or Firm*—Henry S. Jaudon; Cort Flint

[57] ABSTRACT

A multi-layer papermaking fabric for use in a papermaking machine. The multi-layer fabric includes an upper fabric layer having a paper fiber support surface which is formed of first warp yarns interlaced with first weft yarns with at least one of these being knit yarns. Also, the lower fabric layer is formed of second warp yarns interlaced with second weft yarns. The construction of the knit yarns forms a series of loops which extend longitudinally and transversely of their longitudinal axis. These loops form the support surface with increased cover and provide for more uniform drainage of the paper forming fibers.

18 Claims, 2 Drawing Sheets

MULTI-LAYER PRESS FABRIC COMPRISING LOOPED, KNIT YARNS WOVEN IN AN UPPER LAYER OF FABRIC

BACKGROUND OF THE INVENTION

The instant invention is directed to a papermaking fabric for use in the press section of a papermaking machine.

Normally the papermaking fabrics formed for use in the press section comprise multi-layer fabrics formed with a woven or coil formed base fabric having a support fiber batt needled onto its upper surface. This basic structure presents certain problems due to the inherent density of the fiber batt and the large quantities of fluid which is extracted from the paper forming fibers. In use, the pressure exerted by the rolls of the press section for extracting the fluid also acts to compress the fiber batt. Compression of the fiber batt lowers the porosity of the papermaking fabric and reduces its effectiveness. U.S. Pat. Nos. 4,283,454; 4,842,925; and 5,618,612 show known fabrics of this general construction.

Another type press fabric now in use consists essentially of a woven fabric formed of monofilament yarns. These fabrics may be multi-layer with the upper layer being woven to provide a support surface which is more dense than the density of the support fabric. The effort here is to provide a support surface which presents uniform coverage so as to provide uniform drainage and also uniform markings on the paper product. Because of the stiffness and configuration of the monofilament forming yarns, there is a tendency for them to slip or change positions causing the support surface to become uneven which produces non-uniform drainage and non-uniform marks on the paper product. U.S. Pat. Nos. 4,161,195 and 4,518,644 illustrate the manner in which the monofilament yarns shift positions causing unevenness over the fabric surface.

The instant invention is intended to overcome these drawbacks by providing a papermaking fabric having a support which provides substantially uniform cover while at the same time is not subject to blockage as a result of extensive compression.

Accordingly, it is an object of the instant invention to provide a papermaking fabric of stable construction.

Another object of the invention is to provide a multi-layer papermaking fabric in which fabric layers are separate fabrics.

Another object of the invention is to provide in a papermaking fabric a support surface having expanded cover and adequate drainage.

Another object of the invention involves the utilization of knit yarns in the formation of the fabric forming the support surface, thereby providing increased cover.

Another object of the invention is to provide a papermaking fabric having increased and uniform cover along with improved fabric stability.

SUMMARY OF THE INVENTION

The instant invention is directed to a multi-layer papermaking fabric for use in a papermaking machine and its method of forming. The fabric includes a support fabric layer or an upper fabric layer which forms a support surface for supporting paper forming fibers and a carrier fabric layer or a lower fabric layer forming a running surface for engagement with said papermaking machine. The upper fabric comprises first warp yarns interlaced with first weft yarns with at least one of these yarns being a knit yarn. The lower fabric layer comprising second warp yarns interlaced with second weft yarns.

The knit yarns comprise a series of loops which extend longitudinally and transversely of the longitudinal axis of the knit yarn to form the support surface with a covering which is more uniform and more dense that one formed of usual monofilament yarns. The knit construction provides increased and uniform support with improved drainage.

The upper fabric layer normally comprises a woven single layer fabric while the lower fabric layer normally comprises a woven single-layer fabric. The lower fabric layer may also comprise a single-layer fabric.

The knit yarns are formed of continuous filament synthetic yarns which may be monofilament or multi-filament.

The upper fabric layer and the lower fabric layer comprise independent fabrics united together by needling or with binder yarns.

The knit yarns may comprise the weft yarns, the warp yarns or both. The knit yarns may be formed of a synthetic cut filament yarns or of synthetic multi-filament yarns.

The method for forming the multi-layer papermaking fabric includes the steps of:

- forming a first set of warp and weft yarns of synthetic filament yarns;
- weaving the first set of warp yarns with the first set of weft yarns to form a first fabric having a support area;
- increasing the cover of the support area by providing one of the first set of warp and weft yarns is configured as a series of interconnected loops which extend transversely of the longitudinal axis of the yarn;
- weaving a set of longitudinally extending yarns with a set of transversely extending yarns to form a carrier fabric surface; and,
- uniting by needling or stitching the first fabric with the carrier fabric to form a multi-layer papermaking fabric in with the support and running surfaces are exposed.

DESCRIPTION OF THE DRAWINGS

The invention will be more readily understood from a reading of the following specification and by reference to the accompanying drawings forming a part thereof, wherein an example of the invention is shown and wherein:

FIG. 2' is a sectional side of an alternative arrangement of fabric shown in FIG. 2

DESCRIPTION OF A PREFERRED EMBODIMENT

Referring now in more detail to the drawings, the invention will now be described in more detail.

Figure 1:
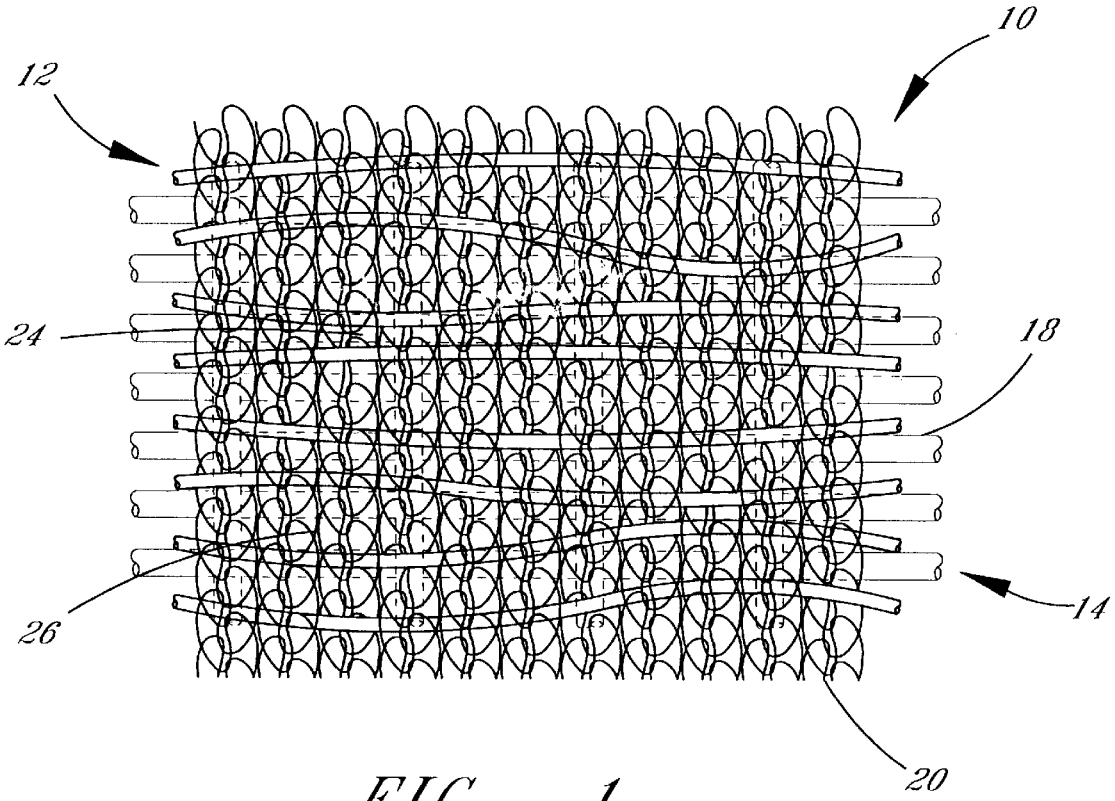
FIG. 1 is a sectional top view of the papermaking fabric of the invention.
Figure 2:
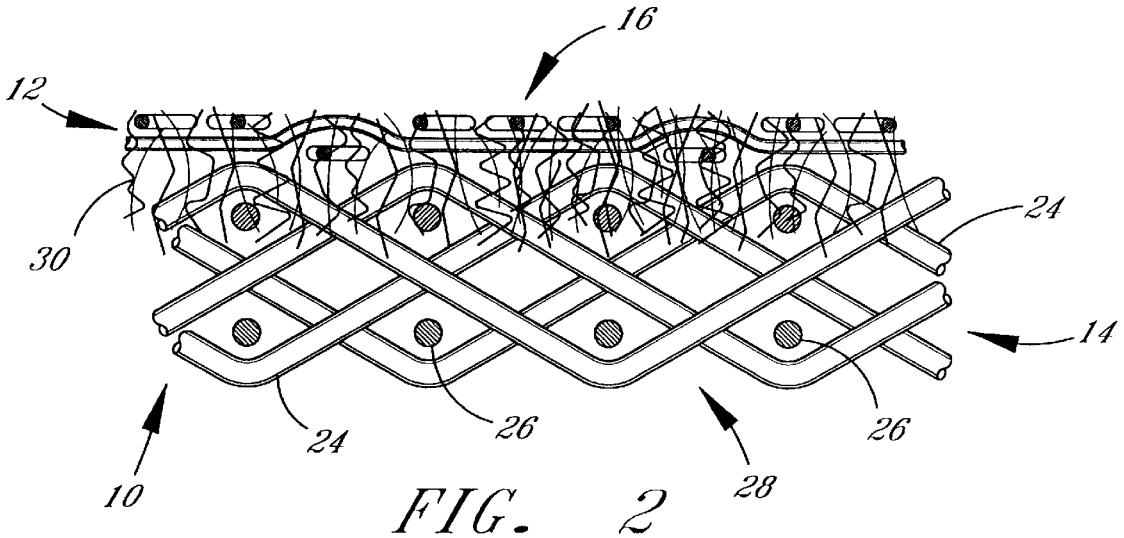
FIG. 2 is a sectional side view of the fabric of FIG. 1.
Figure 2:
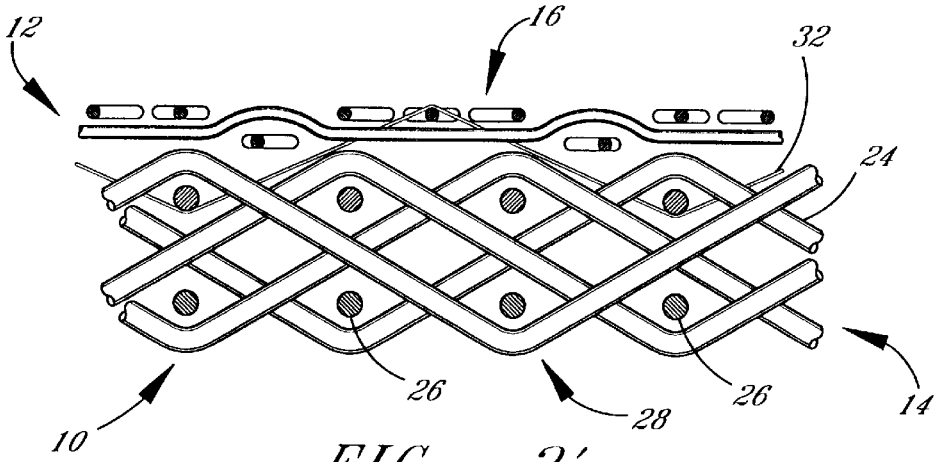

A sectional view of the papermaking fabric of the invention is identified as 10 in FIGS. 1 and 2. Papermaking fabrics are formed generally two ways, i.e., they are woven endless in the form of a continuous loop or they are woven flat and later joined at opposed ends to be continuous. When woven continuous, it is the weft yarns which form the continuous loop and extend in the machine direction. When woven flat, it is opposed ends of the warp yarns which are joined to form the continuous loop and extend in the machine direction.

Press fabric 10 may be formed as either structure, i.e., flat or continuous; however, continuous construction is preferred.

Fabric 10 as shown in FIGS. 1 and 2 is a multi-layer fabric comprising an upper support layer or fabric 12 and a lower carrier layer or fabric 14.

Support fabric 12 includes a paper support surface 16 and is woven in a loose three up, one down twill weave. It is noted that, any weave pattern which will allow sufficient porosity and stability is suitable. Warp yarns 18 which are preferably continuous filament yarns weave under three weft yarns 20 and then over one weft yarns in respecting sequence forming a twill pattern which provides a weft dominated support surface. Constructed as a continuous press fabric, weft yarns 20 extend in the machine direction (MD) and warp yarns 18 extend in the cross machine direction (CMD).

Figure 3:
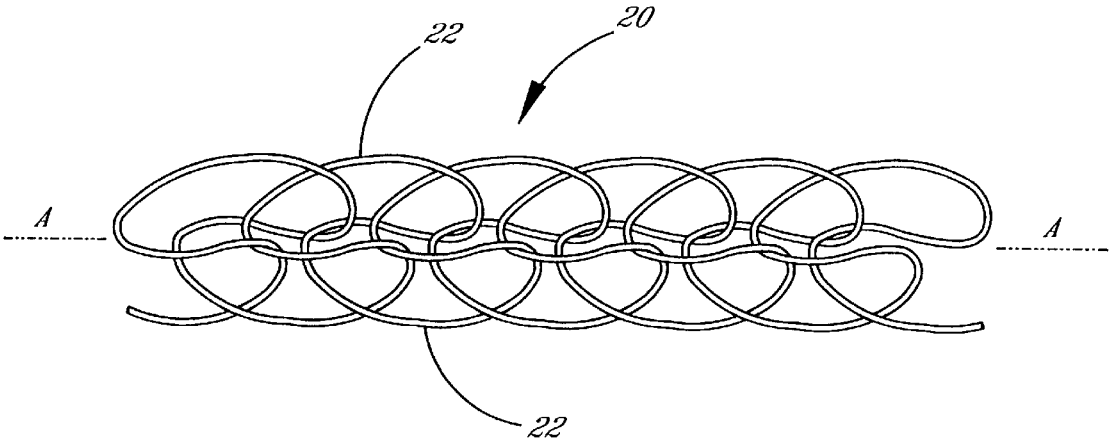
FIG. 3 is a section top view of a knit yarn.

Weft yarns 20 are formed of a continuous filament synthetic yarn knitted into a knit yarn such as shown in FIG. 3. Knitted yarns are well known in the industry and the particular knitted structure forming knit yarn 20 could vary to include patterns which use more than one forming yarn to form the knit yarn. Knitted yarns, due to the looped configurations of the forming yarns, possess elongation capabilities and the capability of being flattened or spread. That is, loops 22 have the ability to extend outwardly in opposed directions from the central axis A of knit yarn 20.

Carrying fabric 14 is shown as a two layered fabric woven in a standard weave. Warp yarns 24 are also arranged in a twill pattern, passing over a first pair of weft yarn 26, between an adjacent pair of weft yarns and finally beneath a pair of weft yarns in a repeating pattern. The lower surface of carrying fabric 14 constitutes running surface 28 of press fabric 10. The particular weave and the number of layers of carrying fabric 14 is optional so long as the necessary porosity and stability is achieved.

Due to the required characteristics of the synthetic monofilaments for forming papermaking fabrics, i.e., wear resistance, heat resistance, chemical resistance and stability against elongation, these filaments are not particularly pliable. This results in the inability to evenly position the forming filaments in the woven fabric, rather these filaments have a random undulating configuration as shown by warp yarns 18 in FIG. 1. A result of these undulations most woven papermaking fabrics have an unevenness in porosity and cover. This may be particularly undesirable for the paper support surface as it may produce unwanted spots and marks in the paper product.

It is noted that both forming yarns of support fabrics 12 may be knit yarns.

By providing that weft yarns 20 of support fabric 12 are knit construction, i.e., formed of a series of loops 22, a support surface having increased cover and uniformity is provided. In the instant fabric, loops 22 tend to spread laterally to cover evenly over areas such as at 26, where warp yarns 18 have spaced themselves and also over other areas, as at 24, where the warp yarns have moved toward each other. The result provides a smooth and even surface over the entire support surface for supporting the paper while at the same time providing sufficient porosity to allow the fluids to drain away from the paper.

Upper support fabric 12 does not function as a load bearing segment of press fabric 10, rather it is supported and stabilized by carrier fabric 14 which is the support or load bearing fabric of the press fabric. Normally support fabric 12 is formed of nylon monofilament warp yarns 18 of between 100 and 1000 denier. Knit weft yarns 20 are normally formed also of nylon monofilament yarns of between 100 and 1000 denier. Other synthetic materials such as polyester are also suitable.

Carrier fabric 14, which is the load bearing fabric in the machine direction is formed with an exposed roller engaging surface 28. The weft and warp yarns forming fabric 14 are monofilament yarns preferably also of nylon of between 100 and 1000 denier.

Press fabric 10 is formed unitary by positioning support fabric 10 on the upper surface of carrier fabric 14 and needling the two fabrics so that fibers or filaments of the forming yarns are intertangled as illustrated at 30 in FIG. 2. These fibers or filaments lock the fabrics together in known manner.

An alternate arrangement for forming unitary press fabric 10 is to again place support fabric 10 on the upper surface of carrier fabric 14 and using spaced binder yarns 32 binding the two fabrics together.

It is desired that support fabric 12 have a drainage capacity of between 5 and 200 CFM and the press fabric 10 have a drainage capacity of between 5 and 200 CFM.

While a preferred embodiment of the invention has been described using specific terms, such description is for illustrative purposes only, and it is to be understood that changes and variations may be made without departing from the spirit or scope of the following claims.

What is claimed is:

1. A multi-layer papermaking fabric for use in a press section of a papermaking machine comprising:

a woven single layer upper fabric forming a support surface for supporting paper forming fibers, said upper fabric comprising first warp yarns interlaced with first weft yarns with at least one of said first warp yarns and first weft yarns comprising knit yarns;

said knit yarns having a series of loops, which extend longitudinally and transversely of the longitudinal axis of said knit yarn, which act to increase cover of said support surface to provide more even support of said paper forming fibers and to provide more uniform drainage of fluid from said paper forming fibers through said upper fabric;

a lower fabric united with said upper fabric, said lower fabric providing longitudinal stability for said papermaking fabric and forming a running surface for engagement with said papermaking machine, said lower fabric layer comprising monofilament second warp yarns interlaced with monofilament second weft yarns;

said monofilament second warp and weft yarns providing drainage openings.

2. The fabric of claim 1 wherein said lower fabric is a woven fabric.

3. The fabric of claim 2 wherein said lower fabric is a multi-layer fabric.

4. The fabric of claim 1 wherein said upper fabric and said lower fabric are united by needling.

5. The fabric of claim 1 wherein each said knit yarn is formed of a continuous monofilament synthetic yarn.

6. The fabric of claim 1 wherein each said knit yarn is formed of a continuous multi-filament synthetic yarn.

7. The fabric of claim 1 wherein said upper fabric is an independent fabric united with said lower fabric with binder yarns.

8. The fabric of claim 1 wherein said first and second warp and weft yarns are continuous filament synthetic yarns.

9. The fabric of claim 1 wherein said knit yarns comprise said first weft yarns.

10. The fabric of claim 1 wherein said knit yarns comprise said first warp yarns.

11. The fabric of claim 1 wherein said papermaking fabric is woven endless.

12. A unitary papermaking fabric for use in a press section of a papermaking machine comprising:

an upper fabric formed of knit weft yarns interwoven with first warp yarns, wherein said knit weft yarns form a paper fiber support surface having even cover, said knit weft yarns and said first warp yarns being continuous filament yarns; and a lower carrier fabric formed of continuous monofilament warp yarns interwoven with continuous monofilament weft yarns, wherein said carrier fabric is formed separate of said upper fabric, and, said upper fabric being united with said carrier fabric by one of needling and binder yarns to form a unitary and stable papermaking fabric.

13. A method of forming a multi-layer papermaking fabric having a support fabric and a carrier fabric comprising:

forming knit yarns of continuous filaments arranged as a series of interconnected loops;

forming said support fabric separate from said carrier fabric by weaving a set of warp yarns with a set of weft yarns to form said support fabric with a support surface, wherein one of said set of warp yarns and weft yarns is comprised of said knit yarns for increasing cover of said support surface;

forming a stable carrier fabric separate from said support fabric by interlacing a set of monofilament longitudinal yarns with a set of monofilament transverse yarns; and uniting said support fabric with said carrier fabric to form a multi-layer fabric in which said support fabric along with said support surface are stabilized by said carrier fabric.

14. The method of claim 13 including forming said carrier fabric by weaving.

15. The method of claim 13 including providing that said weft yarns comprise said knit yarns.

16. The method of claim 13 including uniting said support and carrier fabrics by needling.

17. The method of claim 13 including uniting said support and carrier fabrics with binder yarns.

18. The method of claim 13 including forming said papermaking fabric by weaving said support and carrier fabrics endless.

* * * * *